United States Patent [19]

Sangiorgi

[11] Patent Number: 4,611,978

[45] Date of Patent: Sep. 16, 1986

[54] PRODUCTION LINE FOR BITUMEN CAKES

[76] Inventor: Cesare Sangiorgi, Via Morganti 4, Ravenna, Italy

[21] Appl. No.: 744,863

[22] Filed: Jun. 14, 1985

Related U.S. Application Data

[63] Continuation-in-part of Ser. No. 467,006, Feb. 16, 1983, abandoned.

[30] Foreign Application Priority Data

Feb. 26, 1982 [IT] Italy ..... 84911 A/82

[51] Int. Cl.[4] ..... B29C 33/44

[52] U.S. Cl. ..... 425/73; 425/440; 425/453; 425/253; 425/259; 425/452; 425/404; 425/DIG. 118; 249/127; 264/313; 264/334

[58] Field of Search ..... 264/313, 330, 334; 425/424, 440, 445, 73, 88, 176, 178, 404, 436 R, 446, 453, 297, 253, 256, 259, 452, DIG. 118; 249/127

[56] References Cited

U.S. PATENT DOCUMENTS

| | | | |
|---|---|---|---|
| 1,304,185 | 5/1919 | Jordan | 425/424 |
| 1,541,206 | 6/1925 | Bruce | 425/440 |
| 2,261,952 | 11/1941 | Blomqvist et al. | 249/127 |
| 2,342,743 | 2/1944 | Lutes | 249/127 |
| 2,433,211 | 12/1947 | Gits | 249/127 |
| 3,348,279 | 10/1967 | Shoe | 425/440 |
| 3,353,236 | 11/1967 | Stedman | 425/104 |
| 3,483,908 | 12/1969 | Donovan | 249/127 |
| 3,648,964 | 3/1972 | Fox | 249/127 |
| 3,867,503 | 2/1975 | Shoe | 425/440 |
| 4,035,126 | 7/1977 | Manning | 425/453 |

*Primary Examiner*—Tim Miles

*Attorney, Agent, or Firm*—Guido Modiano; Albert Josif

[57] ABSTRACT

A production line for bitumen cakes comprising sequential processing stations, i.e. a station whereat hot bitumen is cast into basins or pans, a station whereat the bitumen is air cooled, a station whereat the solidified bitumen cakes are shaken out, a station whereat the cakes are packaged in a heat-shrinkable plastic material, and an optional palletization station. The production line is set up to accommodate a plurality of pans which are carried in groups on a plurality of platforms or supporting frames adapted to be cyclically passed through the casting, station, cooling station where they are piled, and shake-out station. The cake shake-out station includes an extraction apparatus equipped with a pusher intended for acting on the outside of the pan bottoms to produce resilient deformation of such bottoms and twisting of the pans to separate the pan from the bitumen cake contained therein.

6 Claims, 20 Drawing Figures

PRODUCTION LINE FOR BITUMEN CAKES

This is a continuation-in-part of patent application Ser. No. 06/467,006 filed on Feb. 16, 1983, now abandoned.

BACKGROUND OF THE INVENTION

This invention relates to a production line for bitumen cakes.

Oxidized bitumen is a peculiar amorphous material which is generally in liquid form when discharged by oxidation plants at a temperature ranging from 240° to 300° C., and becomes solid or pasty at ambient temperatures. While being relatively hot, it is viscous, whereas when in pasty or solid state it possesses a fair degree of elasticity. Both in liquid and in plastic or solid form oxidized bitumen is a highly insulating material with good ahesion properties with respect to almost any solid material.

It is known to produce oxidized bitumen cakes or pigs by casting a mass of liquid bitumen directly into bags formed from a special paper variety and being held within suitable containers which perform the function of molds for the bitumen being solidified in the paper bags. Other methods currently practiced provide for direct casting of hot bitumen into suitable cardboard drums.

These methods suffer all serious drawbacks in that casting in paper bags or cardboard drums must occur at relatively low temperatures to prevent the package from being damaged. At relatively low casting temperature oxidized bitumen becomes highly viscous and any metering, pumping or casting equipment is liable to become clogged or difficult to operate. Moreover, paper bags are sometimes damaged or defective, which results in hot bitumen being spilled on the floor and possibly on the personnel feet.

On the other hand, when bitumen cakes packaged in paper or cardboard are removed from a storing place after relatively long storing time intervals for being melted and used by the consumer, paper or cardboard is often found to be at least partly incorporated in the bitumen cake. Paper hardly peels off from bitumen cakes, remains in the bitumen and must be removed later on by skinning the bitumen once melted.

Also known is to cast hot liquid bitumen into metal containers or molds having a vertical main dimension (i.e. very deep and narrow), which include several component parts and have a bottom which can be opened. Such containers are intended for receiving fluid hot bitumen and serving as solidification molds for the bitumen poured therein while being cooled either through elongate water tanks or through a forced ventilation tunnel. As they emerge out of the cooling tanks or tunnel, the formed bitumen cakes are removed from the containers and then packaged in paper bags or drums.

However, metal composite molds, i.e. molds with removable or movable portions, have some serious disadvantages both from a tehnical standpoint and of the investment involved in their manufacture and installation and of the system maintenance costs. In so far as the technical aspect is concerned, experience has shown that currently used metal molds having movable portions are liable to frequent failures that affect the production output in a drastic way and require very long water cooling lines, which are accordingly very expensive and cumbersome, and thus they occupy large floor areas.

A mold, that has to be opened, cannot be a tight container and thus leaks of liquid bitumen may occur owing to unavoidable clearance between movable components of the mold. Furthermore, when the molds are immersed in a water tank for cooling purposes the hydrostatic thrust is responsible for causing water to leak thrugh the gap between the movable components of the mold and may become incorporated in the liquid bitumen bitumen contained in the mold. This water is subsequently responsible for undesirable formation of foam when bitumen cakes are remelted before bitumen is used.

In addition, even composite molds of more recent design present serious shake-out problems in that the cakes cooled within the metal containers cannot be removed in spite of the action of ultrasound, infrared beams, and mechanical ejectors having been utilized. Frequently, breakage of the metal container occurs before the bitumen cake solidified therein can be shaken out by the ejector.

SUMMARY OF THE INVENTION

It is an object of the present invention to provide a novel production line for the production of bitumen cakes, which makes it possible to solve or substantially eliminate the problems connected with the automatic shaking out of the bitumen cakes, in a simple and economical way.

Another object of the invention is that the said production line has a much reduced size over conventional systems, is highly reliable, and has relatively low running costs.

It is another object of the invention that said production line has no labor requirements for its operation, and is advantageous both by virtue of its high hourly and daily outputs and of its comparatively low manufacturing and installation costs.

These and other objects, are attained by a production line for a production line for oxidized bitumen cakes including a multiplicity of supporting frames each having a plurality of receptacles arranged to removably accomodate and carry a respective mold;

a plurality of metal molds each comprising a relatively shallow pan or basin having a resiliently deformable bottom integral with uniterrupted side wall of walls;

a guide and handling system arranged to sequentially move the supporting frames throughout the plant;

a casting station whereat hot liquid bitumen sequentilly cast in at least one metal mold being carried on a supporting frame;

a cooling station whereat supporting frames carrying molds containing liquid bitumen are stacked one on the other and bitumen cools to yeld bitumen cakes; and a shake-out station comprising an extraction apparatus having adjustable retaining means arranged to act at two diagonally opposite positions on each pan or basin for holding it or them in position in a respective receptacle in its or their supporting frame, and a pusher assembly arranged to act at a controllable rate on the outside of the bottom of each said pans or basins to produce resilient deformation of both the bottom and resilient twisting or torsion of the said pans or basins and cause the said pans or basins to become detached or separated from a respective bitumen cake formed therein.

BRIEF DESCRIPTION OF THE DRAWINGS

Further aspects and advantages of the invention will be more clearly understood from the following detailed description of a preferred, though not limitative, embodiment of a production line according to the invention, with reference to the accompanying drawings, in which.

DESCRIPTION OF THE PREFERRED EMBODIMENT

Figure 1:
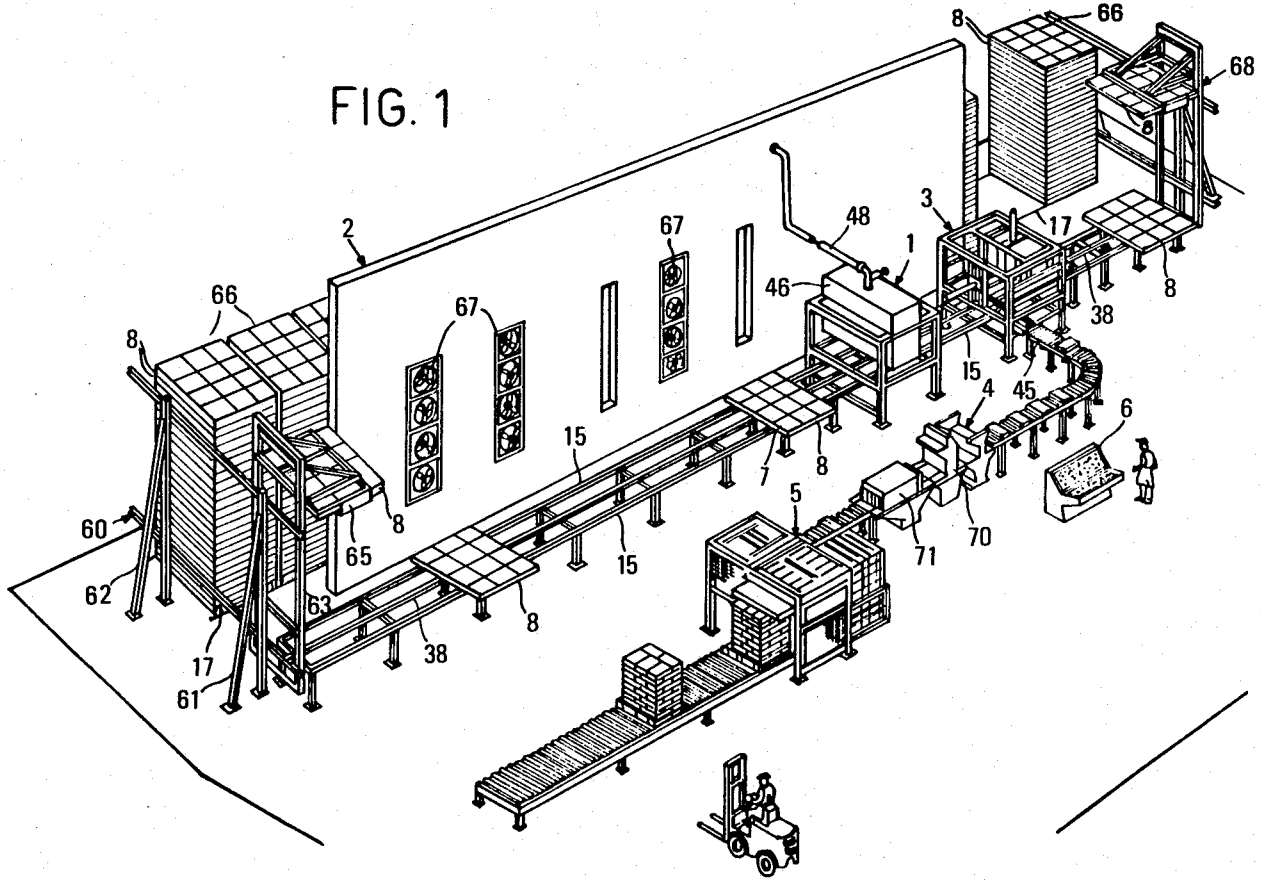
FIG. 1 is a diagrammatic perspective view, taken slightly from above, of a production line according to the invention.
Figure 4:
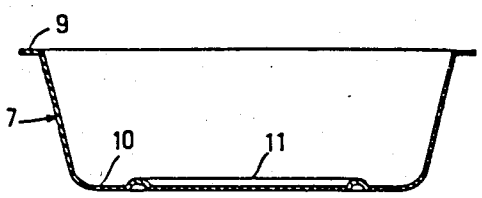
FIG. 4 is a sectional view taken along the line IV—IV of FIG. 2.
Figure 3:
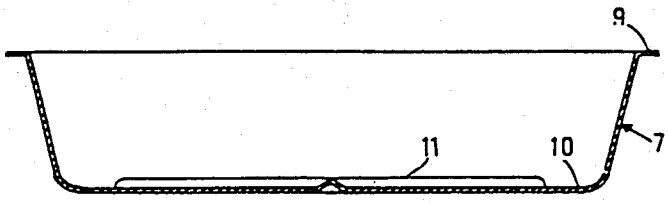
FIG. 3 is a sectional view taken along the line III—III of FIG. 2.
Figure 2:
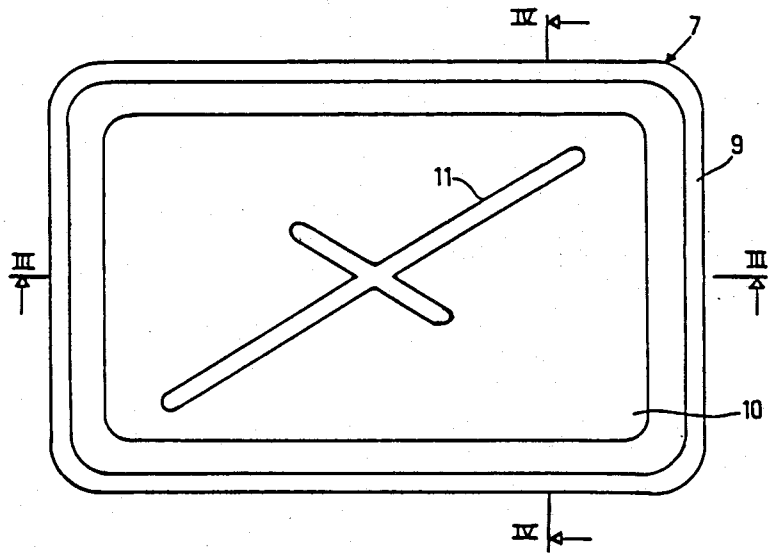
FIG. 2 is a top plan view of a pan or mold.
Figure 7:
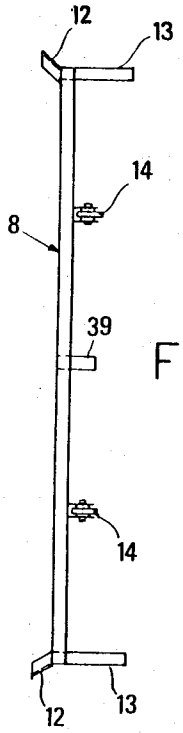
FIG. 7 is a side elevational view of the frame of FIG. 5.
Figure 5:
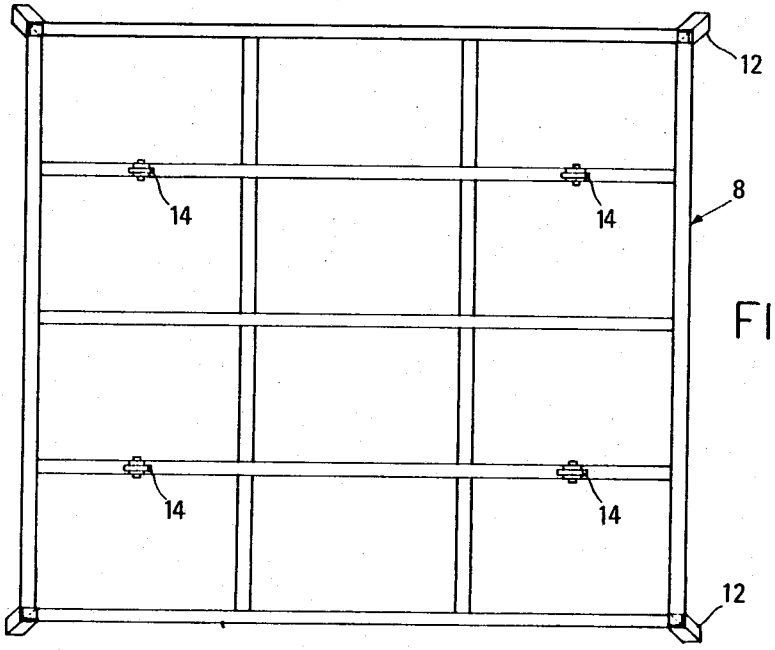
FIG. 5 is a bottom view of a pan-carrying frame.
Figure 6:
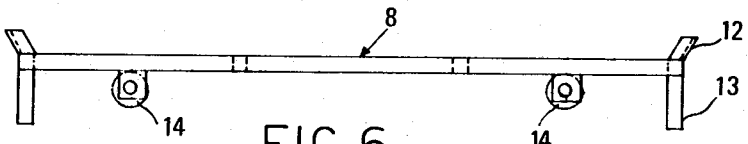
FIG. 6 is a front elevational view of the frame of FIG. 5.

With reference to the Figures of the accompanying drawings, it may be seen that the production line in FIG. 1 for obtaining bitumen cakes includes a plurality of processing stations scattered sequentially along a processing path. More specifically, the production line essentially comprises a bitumen casting station 1, a bitumen cake cooling station 2, a cake shake-out station 3, a cake packaging station 4, a palletizing station 5 for the packaged cakes and elevator-translator stations 60 and 68. All of the processing stations 1 to 5, 60 and 68 can operate in a fully automated manner, the production line being designed to be controlled by a single operator facing a control console 6. Casting at the station 1 takes place intermittently into a plurality, e.g. four, pans or basins 7 at a time (FIGS. 1 to 4). The pans 7 are carried in groups, e.g. groups of twelve on a pan-carrying frame or platform 8 (FIGS. 5 to 10), which keeps them divided and arranged into three rows of four pans each.

The pans 7 have a flanged rim 9 which extends continuously along the entire periphery of the respective pan and may be radiused at the corners. The sidewalls of each pan 7 are flared out to facilitate the removal of the bitumen cakes solidified therein. The bottom 10 of the pans is spanned by two straight recessed ribs or beads 11 which cross each other, may be one longer than the other and extend each in a respective diagonal direction of the pan bottom. The ribs 11 have the dual function of stiffening and facilitating separation from the bitumen cakes cast and cooled within the pans, as will be explained hereinafter.

Advantageously, all of the pans 7 are applied a permanent anti-adhesion inner coating (not shown) comprising a silicone paint, such as a product available on the market under the trade name of Rhodorsil Silicones and produced by the French firm Rhone Poulenc, Paris (France). Advantageously, prior to casting the pans 7 may be sprayed internally (at least for a certain number of casts, while the pans are still new and the anti-adhesion coating has yet to "settle") with a non-acidic anti-adhesive or parting agent, such as a suitable soapy emulsion.

As may be noted, the pans 7 have a horizontal main dimension, in the sense that they are relatively shallow with respect to their length and width dimensions. All this is directed to ensure a relatively small surface area of contact between cast liquid bitumen and side walls of the mold so as to keep to a very low level any adhesion forces and to enable the bitumen, once solidified, to be parted or detached from the pan walls, its top larger area surface being left quite free.

Figure 13:
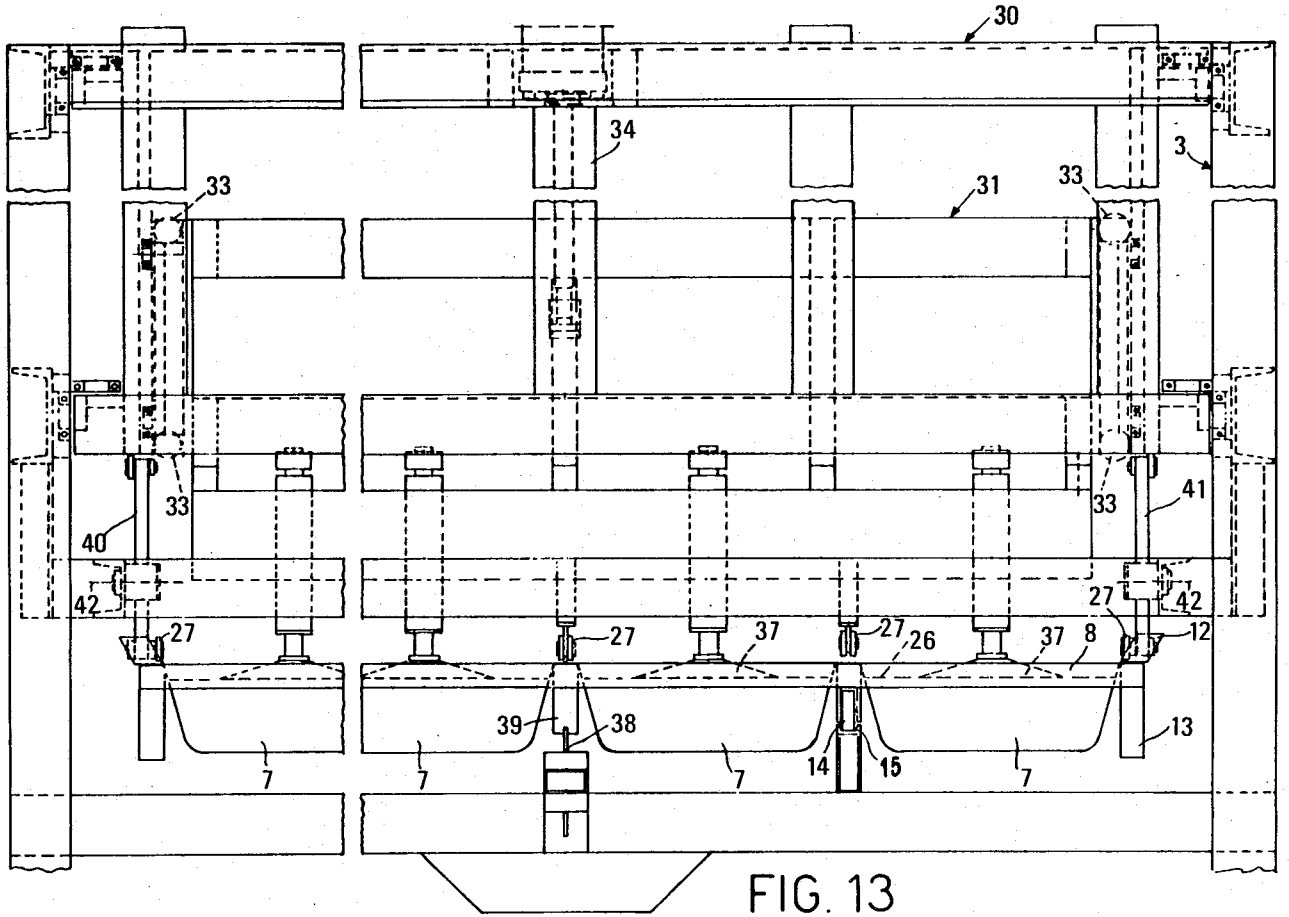
FIG. 13 is a front elevational view of a suction cup knockout apparatus.
Figure 14:
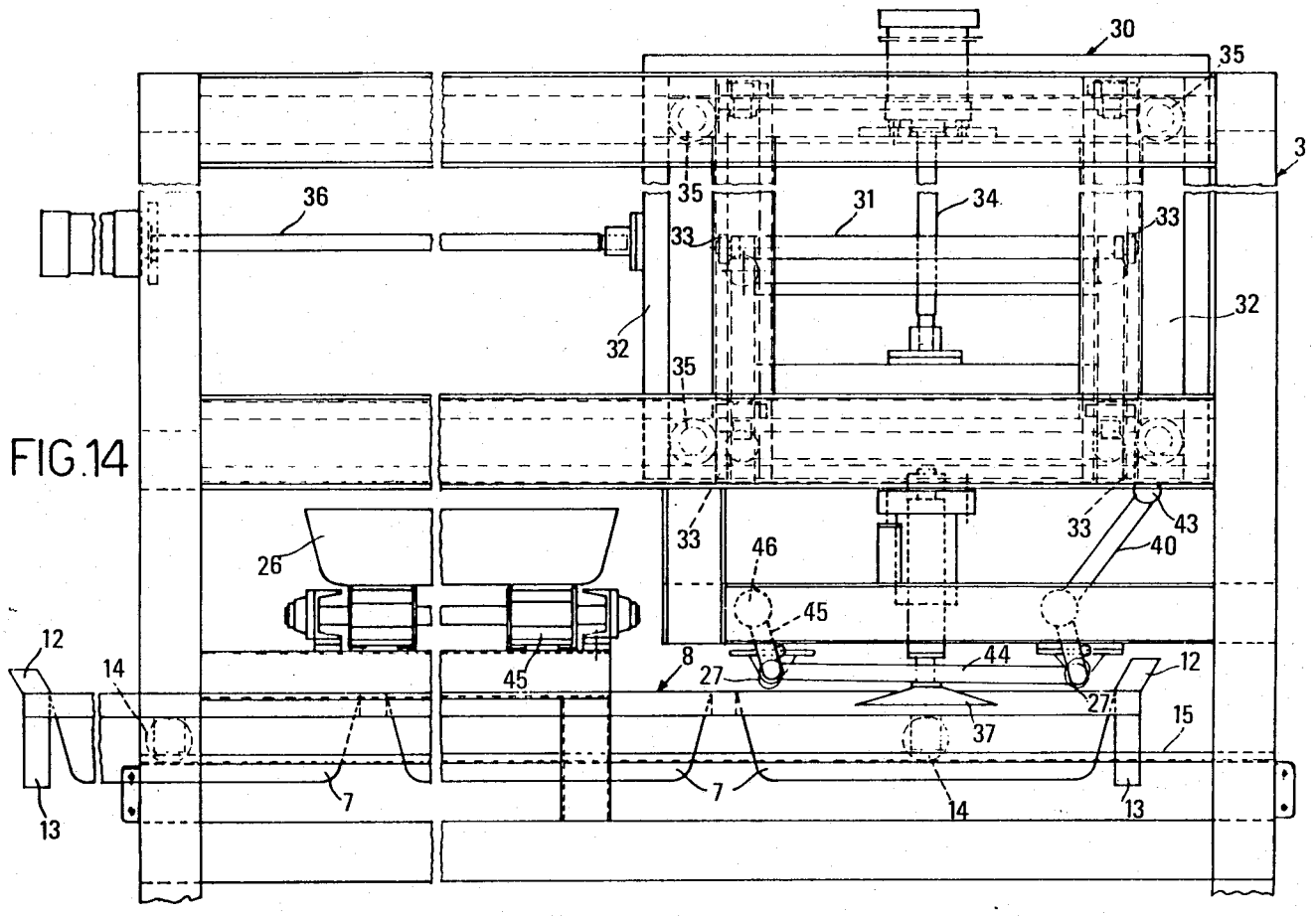
FIG. 14 is a side view of the knockout device of FIG. 13.

Provided in the system shown are, for example, 4,056 pans 7 of pressed sheet metal, which are carried in groups of 12 on specially provided frames 8, to a total of 338 frames. Most of the frames are equal in size and construction to the frame shown in FIGS. 5 to 7, some other frames being identical to the frame shown in FIGS. 8 to 10. The frame shown in FIGS. 5 to 7 has a grid structure defining twelve receptacles for accommodating as many pans 7 which, as mentioned, bear on the frame along their flanged rims 9. Provided at the four corners of the frame 8 are, at the top, four inclined guides 12, and at the bottom, four vertical legs or spacers 13 which, during the piling step, are arranged to slide and locate themselves inside the guides 12 of an underlying frame (as will be explained hereinafter). Each platform or frame 8 is provided on the bottom side with two pairs of rollers 14 aligned in the platform or frame direction of movement and arranged to roll along rails or runways 15 (FIGS. 1, 13 and 14).

Figure 10:
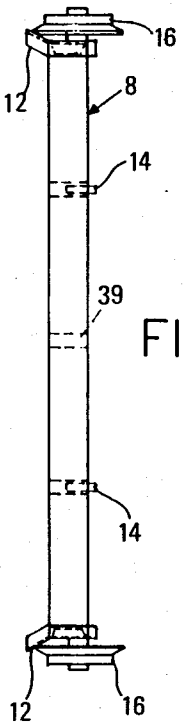
FIG. 10 is a side view of the frame of FIG. 8.
Figure 8:
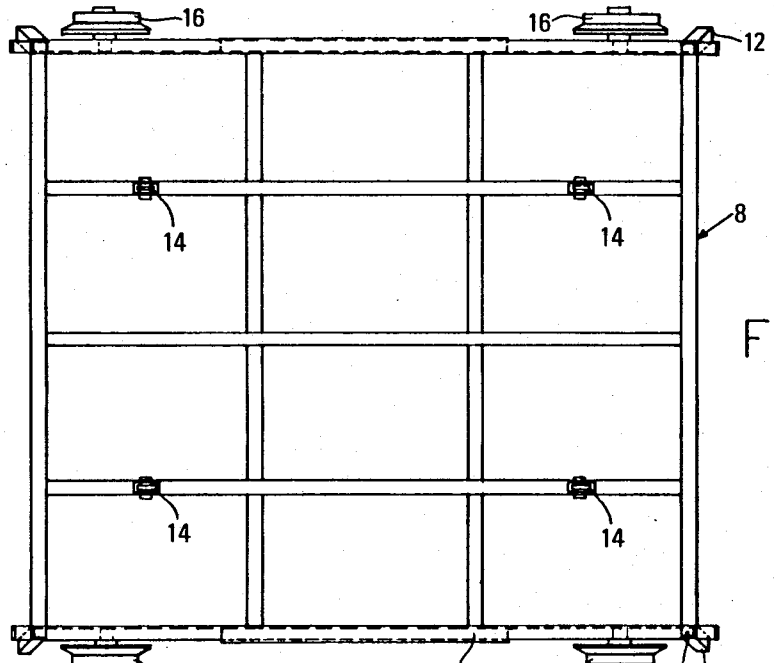
FIG. 8 is a bottom view of a frame provided with side-mounted wheels.
Figure 9:
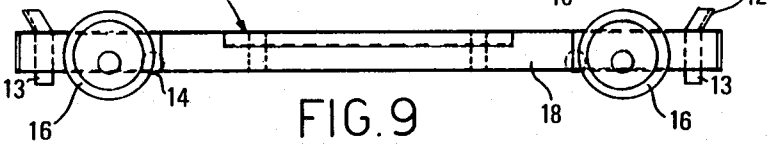
FIG. 9 is a front elevational view of the frame of FIG. 8.
Figure 11:
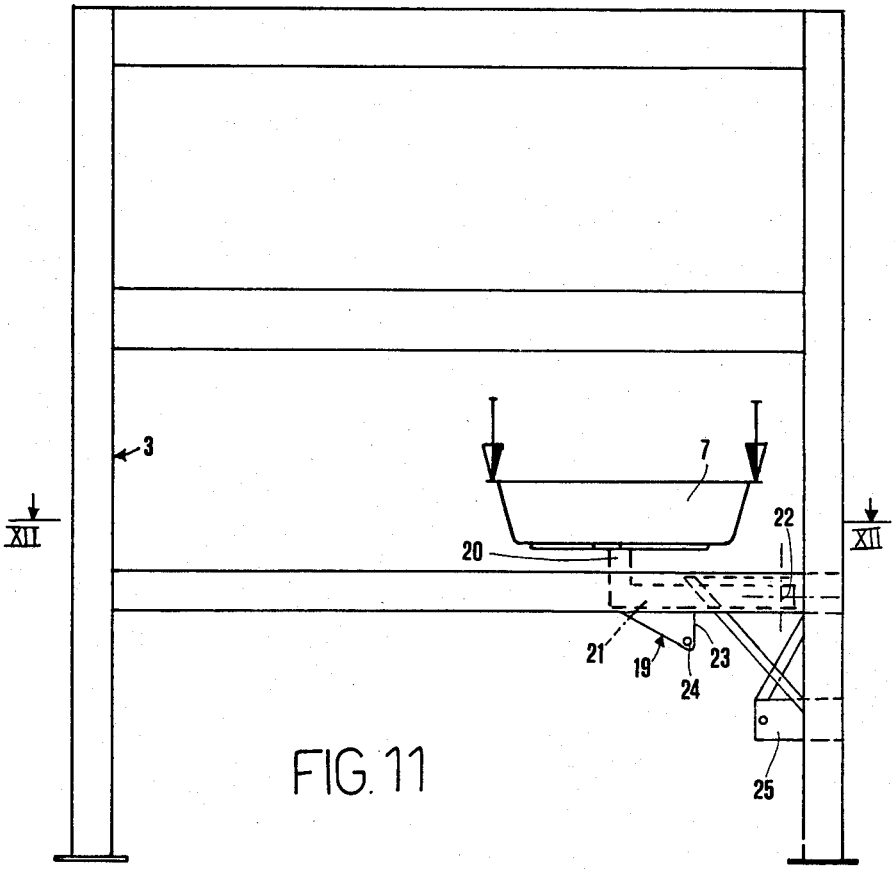
FIG. 11 is a side elvational view of a pusher device incorporated to the shake-out station.
Figure 12:
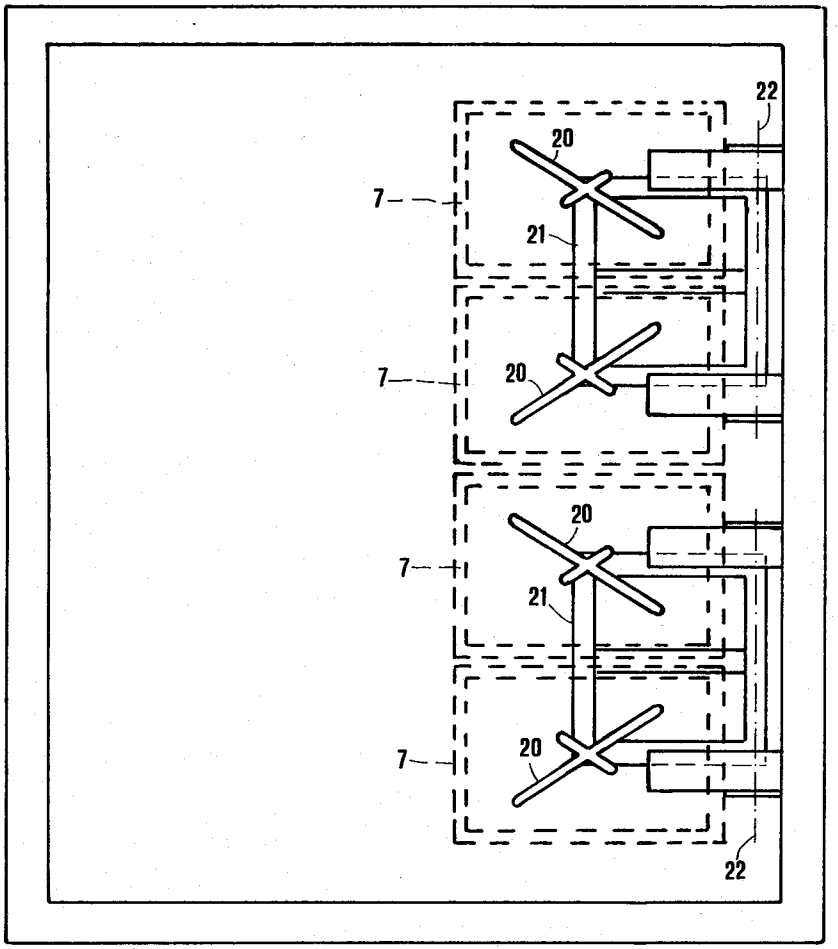
FIG. 12 is a reduced scale, sectional view of the device of FIG. 11, taken along the line XII—XII.
Figure 18:
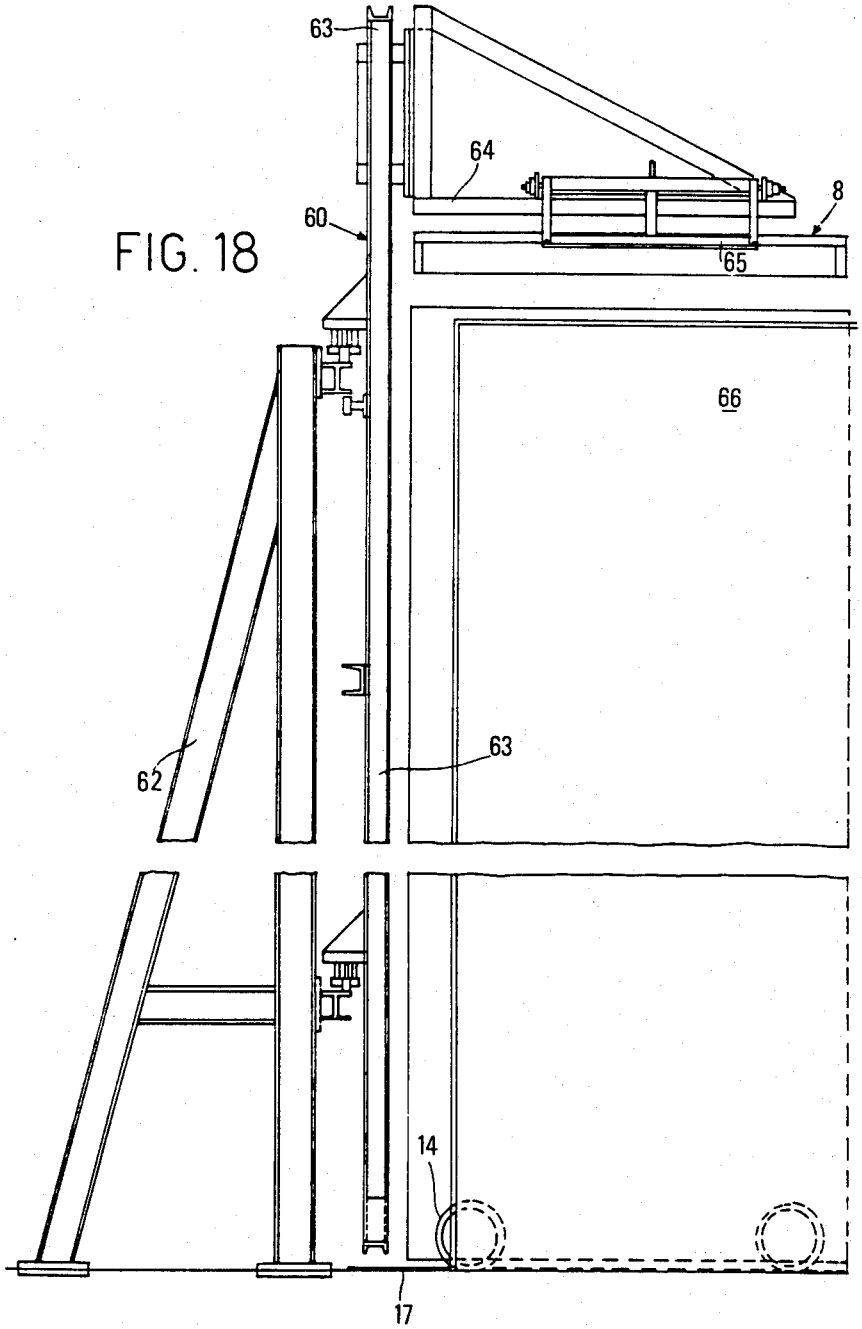
FIG. 18 is a diagrammatic side elevation view of a loader-unloader apparatus for the pan-carrying frames.

The frames of platforms 8 of FIGS. 8 to 10 may be, as an example, thirteen in number, and compared to the other frames, have in addition strengthened oversize side panels 18 and four side-mounted wheels 16 intended for rolling along rails 17 (FIGS. 1 and 18). FIGS. 11 and 12 illustrate a pusher assembly 19 located at the shake-out station 3. The assembly 19 comprises a number of pushers 20, e.g. four pushers, mounted in pairs on a rigid support quadrangular structure 21 which is journalled for rotation about a horizontal axis 22. Advantageously each pusher 20 comprises a short and a long arm crossing each other at the same diagonal inclination as that of the beads 11 in the pans bottom. The pushers 20 are preferably arranged in such a way that one pusher has its long arm extending in one diagonal direction and the next close pusher in the other diagonal direction. In due course each pan may exchange place with a next close one to it so as to be acted upon by a differently orientated pusher, thereby preventing or eliminating permanent deformation of its bottom. Each support structure 21 may be provided with a lug 23 extending downwards and having a bore 24.

The lugs 23 are intended for articulation to one end of a respective actuator jack (not shown), whose other end is articulated, through a bracket 25, to the frame of the station 3.

As a frame 8 is being carried to overlie the four pushers 20 such that the latter are located approximately underneath the bottom of a respective pan 7, it becomes possible to impart a controlled resilient deformation on the pan bottom 10 by operating the actuator jacks of the supporting structures 21. More specifically, the bottom 10 of the pans may be progressively urged upwardly by the pushers 20 at a controlled rate to prevent blows from being imparted to the pans. Blows should be avoided as they are likely to cause cracks in the bitumen cakes and rapidly damage the pan bottom. On the other hand the pushing force applied to the pan bottom must be sufficiently strong and rapid to prevent a bitumen cake 26 contained in each pan from being resiliently deformed, i.e. from having enough time to be able to follow and adapt itself to the pan bottom deformation and the pan twist. Of course such a rate depends on the nature of the oxidized bitumen, ambient temperature and the like. Each pan is pushed upwards while being held in position on the platform 8 by detent rollers 27, shown in FIGS. 13 and 14, which are designed to act on two diagonally opposite rim corners of each pan 7, so that the latter while being deformed is also twisted or torsioned to ensure detachment of the bitumen cake 26 in it.

Figure 11A:
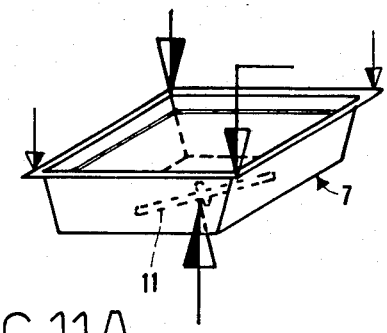
FIG. 11A shows a perspective view of a pan on which shaking out forces indicated by arrows are applied.
Figure 11B:
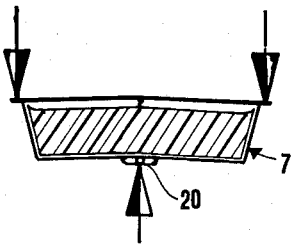
FIG. 11B shows a diagonal cross-section view of the pan of FIG. 11A with its bottom being pushed upwards and its side walls twisted.

In order to cause twisting of the pan, the larger arm of each pusher 20 is arranged in such a way as to extend crosswise with respect to a diagonal passing through the two opposite retention or detent rollers 27 acting on the pan or basin (FIGS. 11A and 11B).

Above the structures 21 and within the station 3, there is located an extraction apparatus 30 with a double carriage 31 and 32 which can be displaced vertically on wheels 33 by an upright jack 34, and crosswise on wheels 35 by a horizontal jack 36 (FIGS. 13 and 14). Extending downwardly from the carriage 31 are a set of four suction cups 37, which are preferably spring loaded and are so aligned as to be centered over a row of four cakes 26 lying in as many pans 7, but substantially free from them.

Once a platform 8 has been moved along the rails 15 by a drive chain 38 engaging with a lower projection 39 on the platform (FIG. 13), such as to bring a respective row of four pans 7 above the pawls 20 and under the suction cups 37, first the carriage 31, and hence the suction cups 37, will be lowered onto the surfaces of the bitumen cakes 26. Simultaneously therewith, the carriage 31 will actuate two side levers 40 and 41, which are each journalled at 42 on the stationary structure of the station 3 and have their top ends fitted with a roller 43 arranged to abut against the carriage 31 and the other ends articulated to a roller 27. The axle of the roller 27 is connected, via a linkage rod 44, to a second end roller 27 depending from the end of an arm 45 journalled at 46 to the stationary structure. The levers 40 and 45 form, together with the rod 44, and articulated parallelogram structure that is controlled by the roller 43 which, as the carriage 31 is lowered, will ensure good contact of the side rollers 27 with the edges of the outermost pans 7 in a row on the platform 8.

With the carriage 31 lowered, the pushers 20 are first brought into action on the bottoms of the basins or pans 7 in a row located beneath the carriage 31, thereafter the suction cups 37 are connected to a vacuum source (not shown) to take hold of the underlying bitumen cakes 26. Should any one hold be less than positive, e.g. if one suction cup 37 fails to make a vacuum-tight seal with the surface of the respective cake 26, then the whole extraction apparatus will stop (owing to the action of control means not shown) until the leaky condition has been corrected. However, if all four of the suction cups 37 engage positively, the carriage 31 will be raised by the jack 34. Thereafter, the jack 36 is brought into action which will move the carriage 32 in a horizontal direction until the suction cups 37, with the cakes 26 attached to them, are taken above a track-type side conveyor 45 onto which the suction cups will drop the cakes 26 (FIGS. 1 and 14) for their removal. The same sequence of operations is repeated for each of the three rows of pans on each platform 8.

The drive chain 38 for the platforms 8 is run both through the shake-out station 3 and through the casting station 1. Thus, while at the station 3 a row of four cakes 26 is being shaken out, it may be arranged for the casting, at the station 1, of liquid bitumen into four pans 7 placed on a platform 8 which has already moved out of the station 3.

Figures 15, 16, 17:
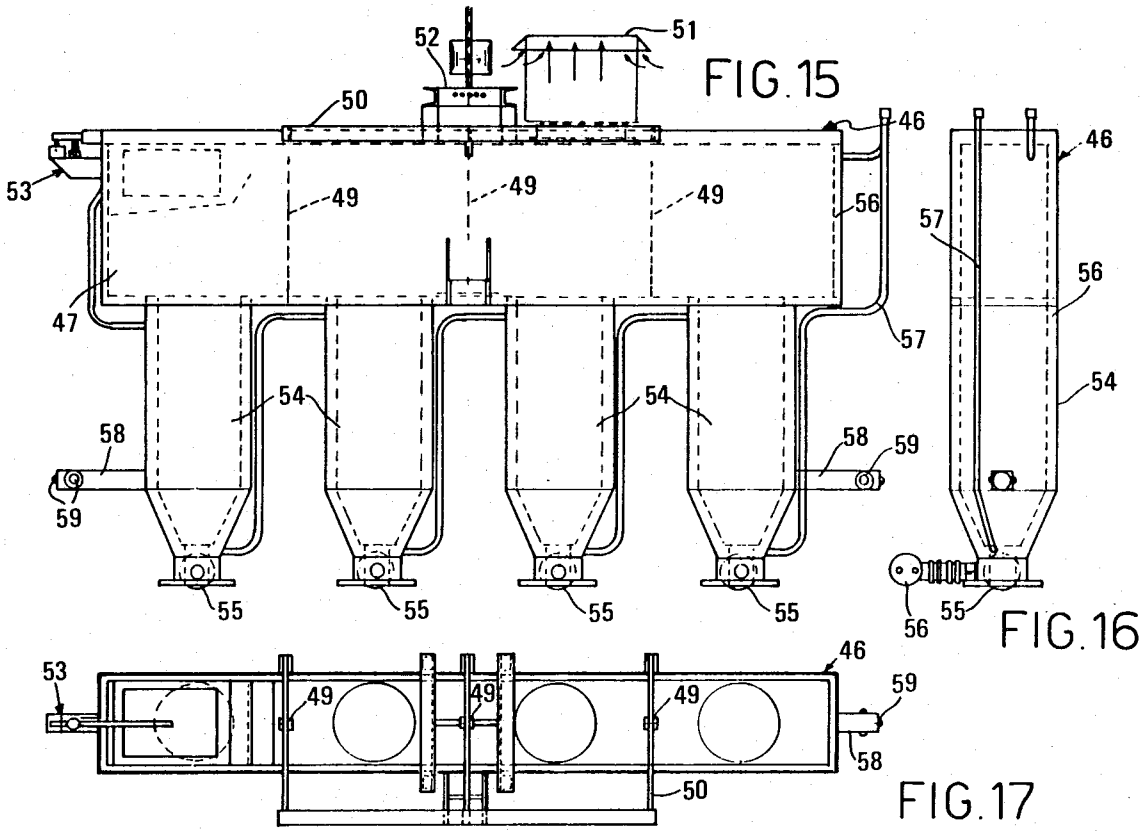
FIG. 15 is a diagrammatic front elevation view of a metering dispenser apparatus for bitumen casting.
FIG. 16 is a side view of the apparatus of FIG. 15.
FIG. 17 is a top view of the apparatus of FIG. 15.

The casting station 1 incorporates a metering-dispenser device 46 (FIGS. 1 and 15 to 17), which comprises a pre-metering vessel 47, which is fed through a limiter valve (not shown) with liquid bitumen from a bitumen source, generally in the form of an insulated line 48 as shown in FIG. 1. Provided on the interior of the vessel 47 are a set of three diaphragms or partitions 49, which are mounted movable in a vertical direction and are spaced apart from one another. The partitions can, through a linkage generally indicated at 50 in FIGS. 15 and 17, be raised and lowered from/into the vessel 47 by means of a jack (not shown). As the vessel 47 is filled up with liquid bitumen, the partitions 49 are held in the raised position to favor a complete and even filling of the vessel 47. Thereafter, they are lowered to volumetrically divide the bitumen poured into the vessel 47 into four equal parts. The vessel 47 is provided at the top with a fume suction fan 51 and with a loading cell 52. The vessel 47 preferably incorporates, on one side thereof, a safety warning mechanism, generally indicated at 53, which has the function of stopping the system in the event of failure to fill or incomplete filling of the vessel 47. The vessel 47 is communicated between the partitions 49 to four infusion devices 54 having all the same inside volume and being provided at the bottom with a respective pouring valve 55 and actuator 56. Both the infusion devices 54 and vessel 47 are lined with a jacket 56 wherethrough a hot fluid is flown via a piping system 57 to keep the bitumen within the metering dispenser 46 in a liquid state (150°–200° C.). The device 46 is preferably guided vertically by rigid arms 58 mounted cantilever-fashion and having at the top three balls 59.

After completion of three consecutive casting operations or cycles by the device 46 and three corresponding forward movement steps by one platform 8, the latter leaves the casting station 1 and is driven by the chain 38 to advance stepwise along the rails 15 until it moves past an elevator-translator apparatus 60 (FIGS. 1 and 18). The apparatus 60 comprises two spaced-apart supporting structures 61 and 62, on which a vertical framework 63 is mounted slidably which can reciprocate between the structures 61 and 62. Mounted on the framework 63 for sliding movement in a vertical direction is a table 64 equipped with two side gripper jaws 65, e.g. of a pneumatically operated type, for gripping the platforms 8.

The apparatus 60 is arranged to sequentially lift the platforms 8 carrying pans 7 filled with bitumen thereon and transport them from the supporting structure 61 to the structure 62, and stack them one on top of the other in stacks or piles 66 containing for instance twenty-five platforms each (FIG. 1). Of course, the arrangement of the platforms 8 is such that at the beginning of each stack there occurs a platform 8 equipped with side-mounted wheels 16 for rolling along the rails 17. Once a stack 66 has been completed, it is caused to advance along the rails 17, e.g. by means of a step jack (not shown).

The rails 17 extend, as an example, through an air cooling tunnel or through a cooling-letting-down area, either in the open air or possibly under forced air circulation, such as by operating one or more blower sets 67.

It will be noted that the stacking of the platforms 8 is facilitated by the provision of the guides 12 and legs 13 thereon, which also serve as spacer elements between any platform and the one directly underneath. Thus, between the various platforms there are created air gaps through which the heat from the bitumen in the pans can be released and, if desired, an airflow may be forced. The provision for stacking the platforms 8 not only affords an effective cooling of the bitumen with simple and inexpensive means, but also a considerable reductions, over prior systems, in size and space requirements for the solidification of the bitumen, with attendant self-evident benefits both of a technical and economical nature.

At the outlet end of the tunnel or cooling area, there is provided a second elevator-translator apparatus 68, wholly similar to the apparatus 60 and, consequently, no further described herein. The device 68 is arranged to pick up, one by one, the platforms 8 from the foremost stack 66 and again transport them along the rails 15 for feeding into the shake-out station 3.

The cakes 26, following their removal from the pans 7 and transferrment onto the conveyor 45, are delivered to a packaging station 4 (FIG. 1) which comprises a wrapping machine 70 operative to package each cake 26 by wrapping in one or more sheets of a heat shrinkable and extensible plastic material. The machine 70 is followed by a kiln 71, wherein the heat shrinkable material is caused to adhere by heat application onto the cakes 26. The cakes 26 leave the kiln 71 in a packaged condition and may be passed to a palletizing station 5.

A system like the one discussed above can afford, for example, a daily output of 100 tonnes of packaged cakes under the supervision of a single operator, who would only interfere in the event of malfunctions, plus one person in charge of the palletizing station.

The cakes 26, for example, may have a weight of 25 kg each, and a parallelepipedal shape measuring approximately 600×400×125 mm, and be packaged in a thin film of heat shrinkable and extendible polyethylene.

The system just described is susceptible to many modifications and variations.

Thus, as an example, instead of a suction cup knock-out device, provision may be made at station 3 for turning the pans 7 upside down after the cake contained therein has come unstuck from the pan walls owing to the action of the pushers 20. Of course, the materials and dimensions may be changed to meet individual applicational requirements.

I claim:

1. A production line for oxidized bitumen cakes including a multiplicity of supporting frames each having a plurality of receptacles arranged to removably accomodate and carry a respective mold;

a plurality of metal molds each comprising a relatively shallow pan or basin having a resiliently deformable bottom integral with uniterrupted side wall or walls;

a guide and handling system arranged to sequentially move the supporting frames throughout the plant;

a casting station whereat not liquid bitumen is sequentilly cast in at least one metal mold being carried on a supporting frame;

a cooling station whereat supporting frames carrying molds containing liquid bitumen are stacked one on the other and bitumen cools to yield bitumen cakes; and a shake-out station comprising an extraction apparatus having adjustable retaining means arranged to act at two diagonally opposite positions on each pan or basin for holding it or them in position in a respective receptacle in its or their supporting frame, and a pusher assembly arranged to act at a controllable rate on the outside of the bottom of each said pans or basins to produce resilient deformation of both the bottom and resilient twisting or torsion of the said pans or basins and cause the said pans or basins to become detached or separated from a respective bitumen cake formed therein.

2. A production line as claimed in claim 1, wherein the said metal molds have a bottom spanned by at least one recessed rib or bead arranged to be engaged by the said pusher assumbly, and a flanged rim designed for engagement by the said retaining means, the or at least one recessed rib or bead extending in a transverse direction with respect to a straight line passing through the two positions at which of the said retaining means are arranged to act, thereby assisting in twisting each pan or basin at the said shake-out station.

3. A production line as claimed in claim 1, wherein the said retaining means comprise an articulated parallelogram structure and contact rollers carried by said parallelogram structure and arranged to rest on or against flanged rims of said pans or basins.

4. A production line as claimed in claim 1, wherein said extraction apparatus comprises a plurality of suction cups arranged to remove bitumen cakes shaked-out from said pans or basins, a first movable support carrying said suction cups and being designed to complete vertical strokes, a second movable support adapted to complete cross strokes and carrying said first movable support, and actuating and control means for said first and second movable supports.

5. A production line as claimed in claim 1, wherein the said casting station comprises a metering dispenser assembly including a vessel adapted to be fed with molten bitumen, a plurality of movable partitions designed to divide the molten bitumen within said vessel into plural portions of equal volume, a plurality of infusion devices in communication with said vessel and arranged each to receive therefrom one of said bitumen portions and deliver it into of said pans or molds, and guide arms having at the free ends thereof three balls for the vertical displacement of said metering dispenser assembly.

6. A production line as claimed in claim 1, further comprising at least one stacker apparatus positioned between said casting station and cooling station and arranged to transport and stack said supporting frames as oncoming from said casting station in said cooling station, and at least one unloader apparatus located between said cooling station and shake-out station and designed to pick up individual platforms from a stack thereof and transport them to the inlet end of said shake-out station, the said stacker apparatus and the said unloader apparatus comprising each a horizontally movable upright framework, a table mounted on said upright framework and designed to perform vertical travel strokes, a gripper assembly mounted on said table and adpted to grip and hold up at least one supporting frame, and control means for said gripper assembly.

* * * * *